United States Patent [19]

Olsen et al.

[11] Patent Number: 4,551,070

[45] Date of Patent: Nov. 5, 1985

[54] NOISE CONTROL FOR CONICALLY PORTED LIQUID RING PUMPS

[75] Inventors: Ole B. Olsen, Newtown; Charles W. Bilik, Norwalk; Herbert H. Johnson, Georgetown; Charles M. Jozepaitis, Bridgeport, all of Conn.

[73] Assignee: The Nash Engineering Company, Norwalk, Conn.

[21] Appl. No.: 685,236

[22] Filed: Dec. 21, 1984

Related U.S. Application Data

[63] Continuation-in-part of Ser. No. 564,881, Dec. 23, 1983.

[51] Int. Cl.[4] ..... F04C 19/00

[52] U.S. Cl. ..... 417/68

[58] Field of Search ..... 417/68, 69, 313

[56] References Cited

U.S. PATENT DOCUMENTS

| | | | |
|---|---|---|---|
| 1,180,613 | 4/1916 | Siemen | 417/68 |
| 1,322,363 | 11/1919 | Siemen et al. | 417/68 |
| 2,195,174 | 3/1940 | Jennings | 417/68 |
| 2,302,747 | 11/1942 | Dardelet | 417/68 |
| 2,344,396 | 3/1944 | Dardelet | 417/68 |
| 2,453,373 | 11/1948 | Kollsman | 417/68 |
| 3,348,766 | 10/1967 | Mugele | 417/68 |
| 3,352,483 | 11/1967 | Allen | 417/68 |
| 3,366,314 | 1/1968 | Schroder | 417/68 |
| 3,721,508 | 3/1973 | Mugele | 417/68 |
| 3,743,443 | 7/1973 | Jennings | 417/68 |
| 3,884,596 | 5/1975 | Hoffmeister | 417/68 |
| 4,251,190 | 2/1981 | Brown et al. | 417/68 |
| 4,273,515 | 6/1981 | Fitch | 417/68 X |
| 4,392,783 | 7/1983 | Jozepaitis | 417/68 |

FOREIGN PATENT DOCUMENTS

| | | | |
|---|---|---|---|
| 0071715 | 2/1983 | European Pat. Off. | 417/68 |
| 258483 | 4/1913 | Fed. Rep. of Germany | 417/68 |
| 949765 | 3/1956 | Fed. Rep. of Germany | 417/68 |
| 2731451 | 4/1978 | Fed. Rep. of Germany | 417/68 |
| 2704863 | 8/1978 | Fed. Rep. of Germany | 417/68 |
| 1249020 | 11/1960 | France | 417/68 |
| 555428 | 6/1978 | Japan | 417/68 |
| 5587385 | 12/1978 | Japan | 417/68 |
| 55-5427 | 1/1980 | Japan | 417/68 |
| 73493 | 7/1926 | Sweden | 417/68 |
| 11378 | of 1905 | United Kingdom | 417/68 |
| 2064002A | 6/1981 | United Kingdom | 417/68 |

*Primary Examiner*—William L. Freeh
*Assistant Examiner*—Paul F. Neils
*Attorney, Agent, or Firm*—Robert R. Jackson; David W. Plant

[57] ABSTRACT

In liquid ring pumps having conical port members, cavitation and associated operating noise are reduced by providing a second subsidiary discharge port beyond the closing edge of the main discharge port in the direction of rotor rotation.

5 Claims, 11 Drawing Figures

12
14
16
18
20
22
24
28
30
32
34
36
38
40
50
52
54
58
64
68
70
80
82
90
94
98
100
104
108
110
2
2

Fig. 3.
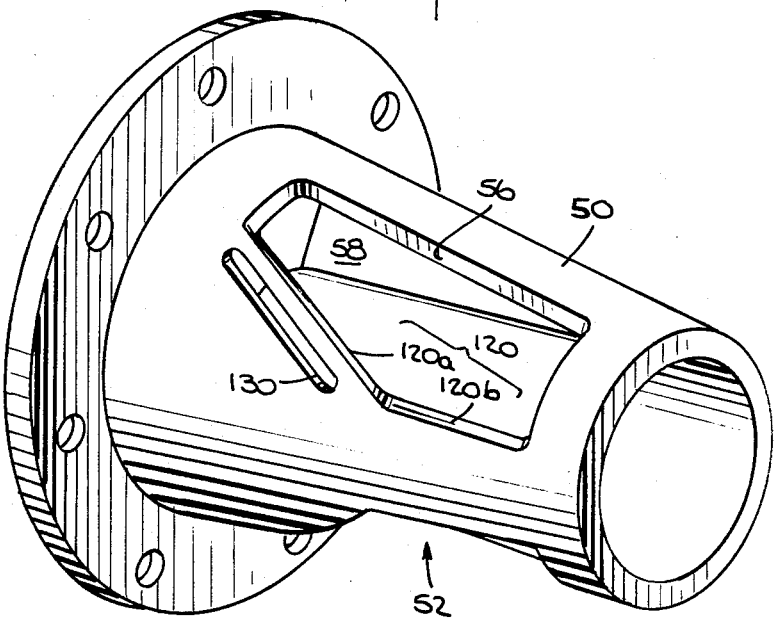
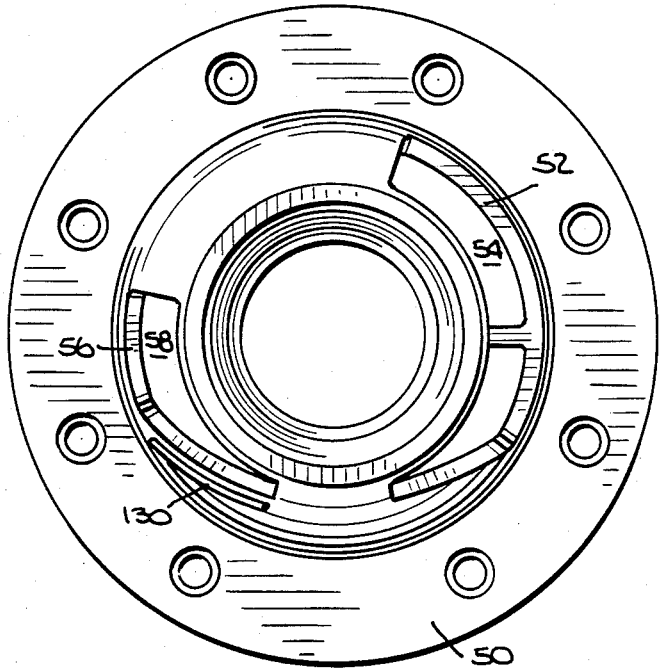
Fig. 4.

NOISE CONTROL FOR CONICALLY PORTED LIQUID RING PUMPS

This is a continuation-in-part of application Ser. No. 564,881, filed Dec. 23, 1983.

BACKGROUND OF THE INVENTION

This invention relates to liquid ring pumps, and more particularly to reducing cavitation and its associated operating noise in liquid ring pumps, especially those having conical port members.

A typical liquid ring pump having conical port members is shown in Adams U.S. Pat. No. 3,289,918. Although the port members in pumps of the type shown in the Adams patent are actually frusto-conical, those skilled in the art usually refer to such port members as conical, and that terminology is also sometimes employed herein.

Cavitation sometimes occurs in conically ported liquid ring pumps, particularly those which are operated with high ratios of condensable to noncondensable vapors, at high speeds, and/or at low intake pressures (i.e., intake pressures near zero absolute pressure). Cavitation is believed to be caused by the sudden collapse or implosion of vapor bubbles near the interface between the gas being pumped and the pumping liquid (usually water) which constitutes the liquid ring. Vapor bubbles formed on the intake side of the pump may suddenly collapse when subjected to increased pressures in the compression area along with the abrupt redirection of flow which is characteristic of the discharge port area. The after-effects of the sudden collapse or implosion of these vapor bubbles may be objectionably audible outside the pump. The forces associated with numerous and repeated implosions occurring adjacent to the internal components of the pump may physically damage those components.

There are unique cavitation problems associated with conically ported liquid ring pumps. When cavitation occurs in pumps of this design, damage often concentrates at the closing edge of the discharge port. This is understandable since a portion of this edge is skewed, or sloped, in the direction of rotor rotation; thus, it constitutes the first major obstruction in the path of the compressed vapor bubbles.

Elimination of the skewed port boundary may reduce cavitation; but it would also reduce volumetric efficiency of the pump by creating a uniform duration gas discharge cycle. Conically ported liquid ring pumps rely on progressive purging (or duration discharge cycle) along the length of the discharge port member to achieve maximum volumetric efficiency. The skewed discharge port boundary is essential to achieving this result. The gas discharge cycle is of shorter duration at the end of the port member with relatively large circumference. In the foregoing description, length of the port member is measured parallel to the long axis of the rotor blades or pump shaft.

It is therefore an object of this invention to reduce cavitation in liquid ring pumps having conical port members.

It is another object of this invention to reduce the operating noise levels, and other negative effects of cavitation, in liquid ring pumps having conical port members. This is accomplished by providing for calibrated venting of vapor bubbles while retaining the gas discharge cycle whose duration varies according to the location along the main axis of the port member (i.e., parallel to the pump shaft).

SUMMARY OF THE INVENTION

These and other objects of the invention are accomplished in accordance with the principles of the invention by providing a liquid ring pump including a first main discharge port of conventional design with a closing edge having a segment which is inclined in the direction of rotor rotation from a first relatively large circumference portion of the conical port member to a second relatively small circumference portion of the port member, and a second subsidiary discharge port beyond the inclined segment in the direction of rotor rotation.

Further features of the invention, its nature and various advantages will be more apparent from the accompanying drawings and the following detailed description of the invention.

BRIEF DESCRIPTION OF THE DRAWINGS

FIG. 3 is a perspective view of the first stage port member in the pump of FIGS. 1 and 2.

FIG. 4 is an end view of the port member of FIG. 3.

DETAILED DESCRIPTION OF THE INVENTION

Figure 1:
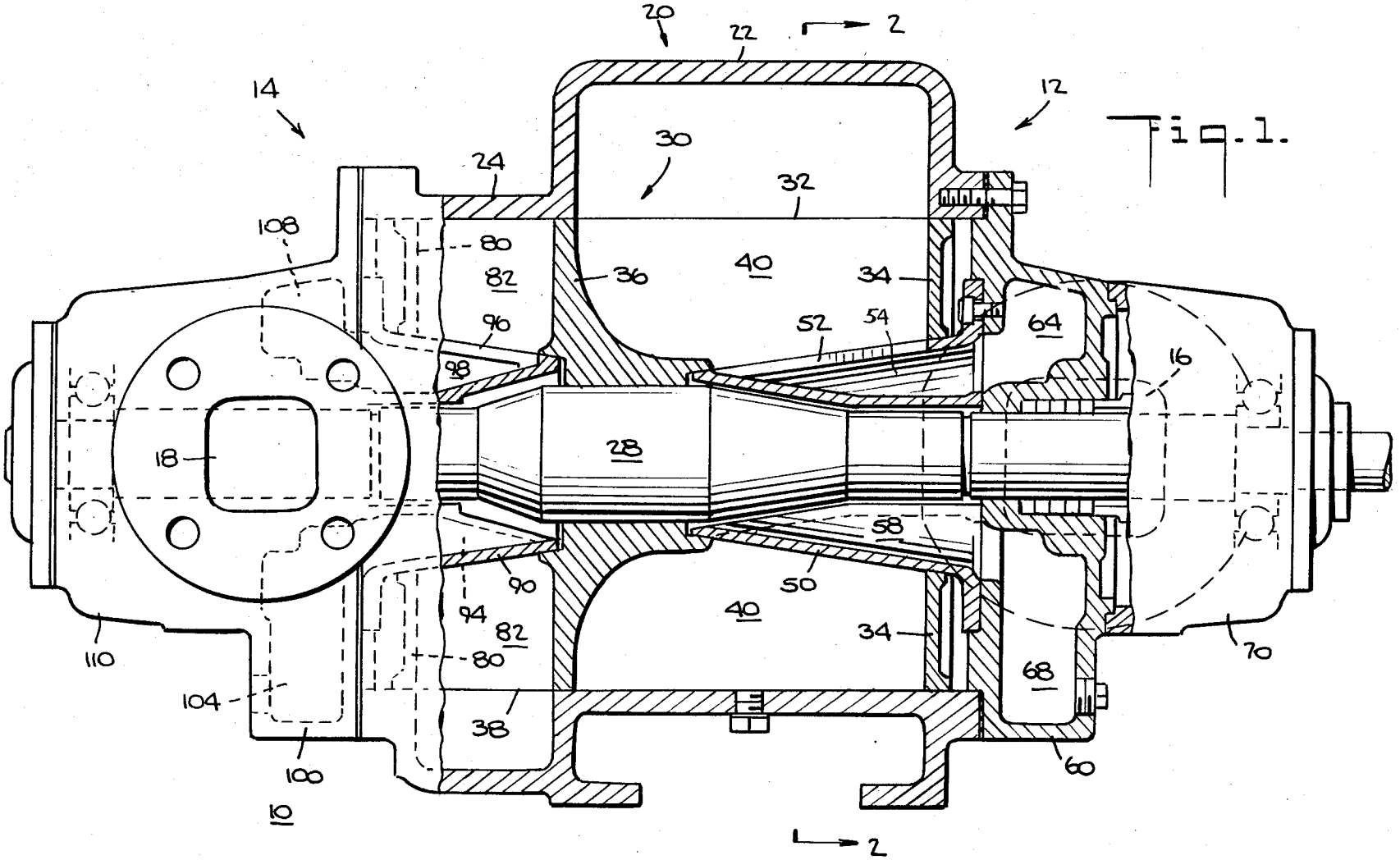
FIG. 1 is an elevational view, partly in section, of an illustrative conically ported two-stage liquid ring pump constructed in accordance with the principles of the invention.

The liquid ring pump 10 shown in the drawings is a two-stage pump having a first stage 12 on the right in FIG. 1 and a second stage 14 on the left in that Figure. Gas or vapor to be pumped (hereinafter generically referred to as gas) enters the pump via inlet opening 16 and, after successively passing through the first and second stages, exits from the pump via outlet opening 18.

The pump has a generally annular housing 20 including a first stage portion 22 and a second stage portion 24. Rotatably mounted in housing 20 is a shaft 28 and a rotor 30 fixedly mounted on the shaft. Rotor 30 has a first stage portion 32 extending from annular end shroud 34 to annular interstage shroud 36. Rotor 30 also has a second stage portion 38 extending from interstage shroud 36 to annular end shroud 80. Circumferentially spaced, radially extending, first stage rotor blades 40 extend from interstage shroud 36 to end shroud 34. Circumferentially spaced, radially extending, second stage rotor blades 82 extend from interstage shroud 36 to end shroud 80.

Adjacent to end shroud 34, rotor 30 has a first frusto-conical bore concentric with shaft 28. Frusto-conical first stage port member 50 (sometimes referred to for convenience herein as conical port member 50) extends into this bore between shaft 28 and rotor 30. Port member 50 is fixedly connected to first stage head member 60, which is in turn fixedly connected to housing 20. Bearing assembly 70 is fixedly connected to head member 60 for rotatably supporting shaft 28 adjacent the first stage end of the pump.

Adjacent to end shroud 80 a second frustoconical port member 90 extends into a second frustoconical bore in rotor 30. Port member 90 is concentric with shaft 28 and is fixedly mounted on second stage head member 100, which is in turn fixedly mounted on housing 20. Bearing assembly 110 is fixedly mounted on head member 100 for rotatably supporting shaft 28 adjacent the second stage end of the pump.

First stage housing portion 22 is eccentric to first stage rotor portion 32, and second stage housing portion 24 is similarly eccentric to second stage rotor portion 38. Both portions of housing 20 are partially filled with pumping liquid (usually water) so that when rotor 30 is rotated, the rotor blades engage the pumping liquid and cause it to form an eccentric ring of recirculating liquid in each of the two stages of the pump. In each stage of the pump this liquid cyclically diverges from and then converges toward shaft 28 as rotor 30 rotates. Where the liquid is diverging from the shaft, the resulting reduced pressure in the spaces between adjacent rotor blades constitutes a gas intake zone. Where the liquid is converging toward the shaft, the resulting increased pressure in the spaces between adjacent rotor blades constitutes a gas compression zone.

Figure 2:
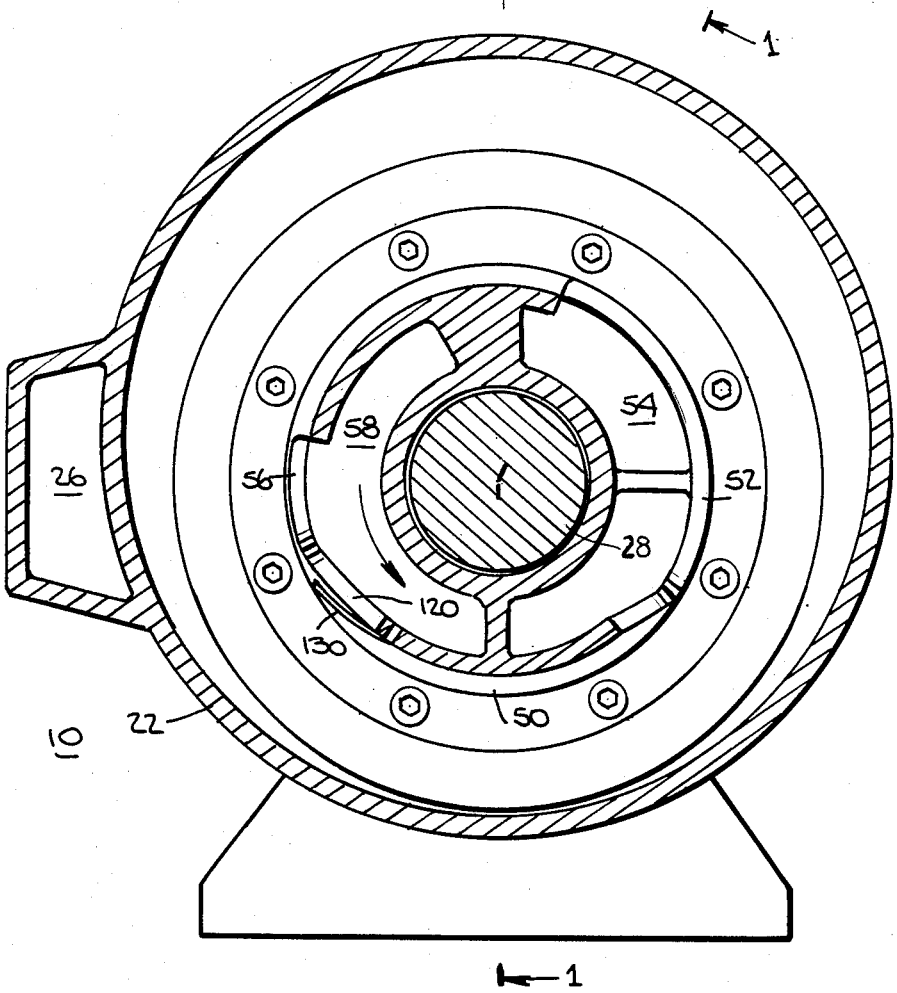
FIG. 2 is a cross-sectional view taken along the line 2—2 in FIG. 1, but with the rotor of the pump removed.

First stage port member 50 includes an inlet port 52 for admitting gas to the intake zone of the first stage of the pump. Port member 50 also includes a discharge port 56 for allowing compressed gas to exit from the compression zone of the first stage. Gas is conveyed from inlet opening 16 to inlet port 52 via conduit 64 in head member 60 and conduit 54 in port member 50. Gas discharged via discharge port 56 is conveyed from the first stage via conduit 58 in port member 50 and conduit 68 in head member 60. This gas is conveyed from first stage head member 60 to second stage head member 100 via interstage conduit 26 (FIG. 2) which is formed as part of housing 20.

Second stage port member 90 includes an inlet port (not shown) for admitting gas to the intake zone of the second stage of the pump, and a discharge port 96 for allowing gas to exit from the second stage compression zone. Gas is conveyed from interstage conduit 26 to the second stage inlet port via conduit 104 in head member 100 and conduit 94 in port member 90. Gas discharged via second stage discharge port 96 is conveyed to outlet opening 18 via conduit 98 in port member 90 and conduit 108 in head member 100.

As is conventional in two-stage liquid ring pumps, the first stage discharge pressure (which is approximately equal to the second stage intake pressure) is substantially greater than the first stage intake pressure, and the second stage discharge pressure is substantially greater than the second stage intake pressure. For example, in a typical vacuum pump installation, the first stage intake pressure is near zero absolute pressure, the second stage discharge pressure is atmospheric pressure, and the interstage pressure (i.e., the first stage discharge and second stage intake pressure) is intermediate these other pressures.

Cavitation sometimes occurs in single-stage and two-stage pumps of the type described above, most especially near the inclined portion of the first stage discharge port, where the gas discharge cycle is of the shortest duration. A considerable amount of noise may accompany this cavitation.

It has been found that both cavitation and the associated noise can be reduced or eliminated by augmenting the discharge port with which the cavitation is associated (usually, but not always, the first stage discharge port 56 in two-stage pumps of the type shown in the drawings and described above) by providing a second, relatively small, subsidiary discharge port 130 located just beyond the closing edge of the main discharge port.

The effectiveness of this subsidiary discharge port in reducing cavitation is much greater than that achieved by simply enlarging main discharge port 56 to encompass the area occupied by subsidiary discharge port 130 and the wall segment between main and subsidiary discharge ports 56 and 130. It is believed that the inclined boundary **120*a* of the main port 56 must be retained to properly control the duration of the gas discharge cycle in the corresponding axial segment of the main port and the communicating gas-conveying space of the rotor bucket defined by the space between two adjacent rotor blades, the inner boundary of the liquid ring, and an axial segment of main discharge port 56. At the same time, subsidiary discharge port 130 provides for calibrated venting and dispersal of vapor bubbles carried over from the intake side of the pump. The intervening cone member surface between main and subsidiary discharge ports 56 and 130 is believed essential to successful independent functioning of each of discharge ports 56 and 130**.

In the pump configuration shown in the drawings, the closing edge 120 of discharge port 56 has two segments **120*a* and 120*b*. Segment 120*a* is inclined in the direction of rotor rotation from point X (FIG. 5) on a first relatively large circumference portion of port member 50 to point Y on a second relatively small circumference portion of port member 50. Segment 120*b* is axial (i.e., substantially coplanar with the rotational axis of rotor 30) and extends from point Y on the second relatively small circumference portion of port member 50 to point Z on a third still smaller circumference portion of port member 50. The subsidiary discharge port 130 of this invention is preferably located in the area of the surface of port member 50 which is bounded by (1) inclined closing edge segment 120*a*, (2) the first relatively large circumference of port member 50 which passes through point X, and (3) a line coincident with axial closing edge segment 120*b*. More preferably, subsidiary discharge port 130 is a longitudinal slot substantially parallel to inclined closing edge portion 120*a*. Most preferably, the slot which forms subsidiary discharge port 130 extends from the above-mentioned relatively large circumference of port member 50 to the above-mentioned line coincident with axial closing edge segment 120*b***. This most preferred embodiment is shown in the drawings.

Although in the embodiment shown in FIGS. 1–5 a unitary subsidiary discharge port 130 is employed, the subsidiary discharge port could be made up of a plurality of apertures in port member 50 if desired. For example, subsidiary discharge port 130 could be made up of a series of circular holes **130*a* as shown in FIG. 6. These holes need not all be of the same diameter. This is illustrated by FIG. 7 in which holes 130*b–3* have progressively larger diameters from hole 130*b* near point X to hole 130*e* near point Y. It is also not necessary that the holes be circular. This is illustrated by FIG. 8 in which holes 130*f* and 130*k* are circular, but intermediate holes 130*g–j* are elongated substantially perpendicular to inclined closing edge portion 120*a*. Other possible alternatives include the use of two or more longitudinal slots having the same orientation as slot 130 in FIG. 5 and arranged either end-to-end (e.g., slots 130*m* and 130*n* in FIG. 9) or side-by-side (e.g., slots 130***p* and 130*q* in FIG. 10).

Figure 11:
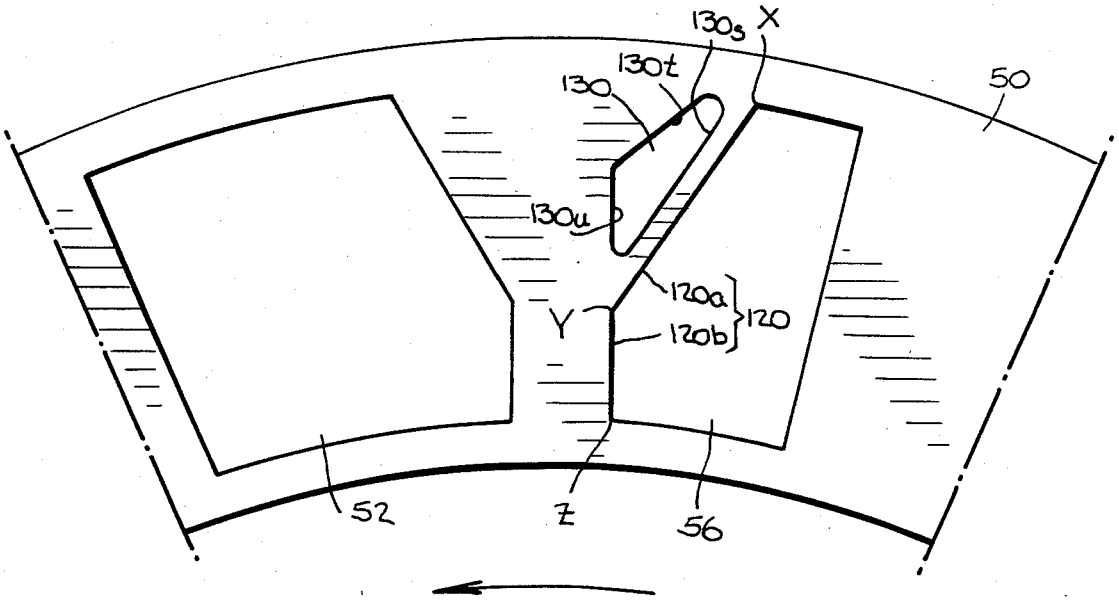

FIG. 11 illustrates still another possible alternative in which subsidiary discharge port 130 has an opening edge 130*s* which is substantially parallel to inclined closing edge portion 120*a*, but a closing edge which is not parallel to inclined closing edge portion 120*a*. In the particular embodiment shown in FIG. 11, the closing edge of subsidiary discharge port 130 includes closing edge portion 130*t* which is inclined in the direction of rotor rotation from a relatively large circumference portion of port member 50 to a somewhat smaller circumference portion of port member 50, and closing edge portion 130*u* which is axial and which extends from the somewhat smaller circumference portion of port member 50 to a still smaller circumference portion of the port member.

Figure 5:
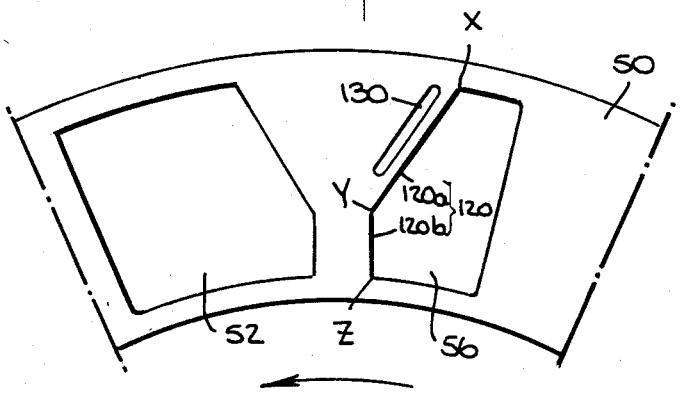
FIG. 5 is a planar projection of the frusto-conical surface of the port member shown in FIGS. 3 and 4.
Figure 6:
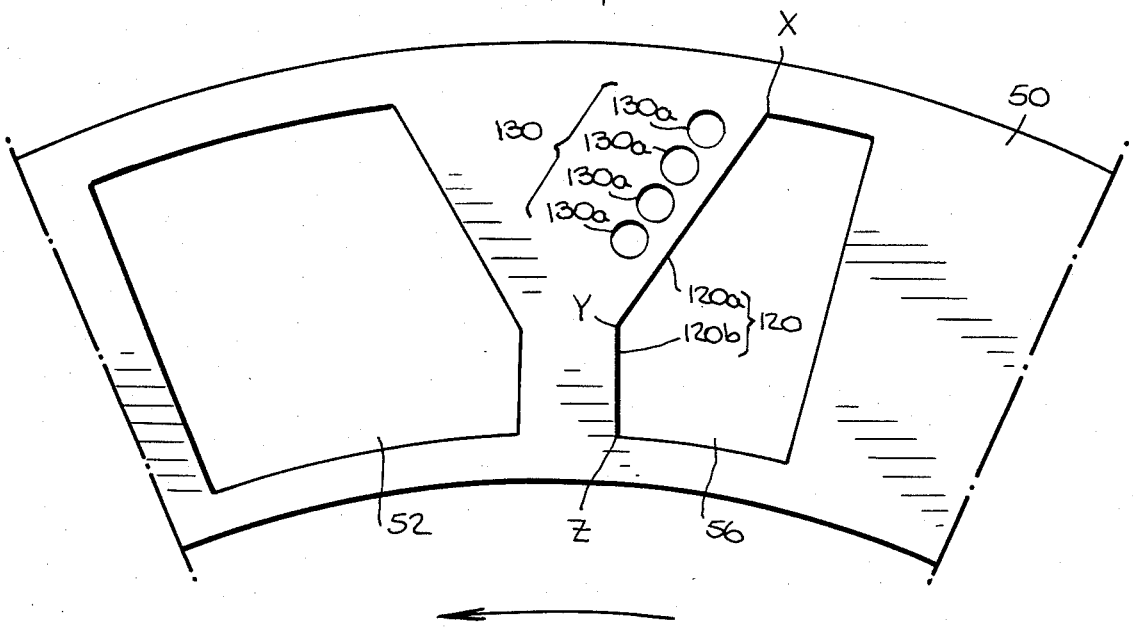
FIGS. 6–11 are views similar to FIG. 5 showing several alternative embodiments of the invention.
Figure 7:
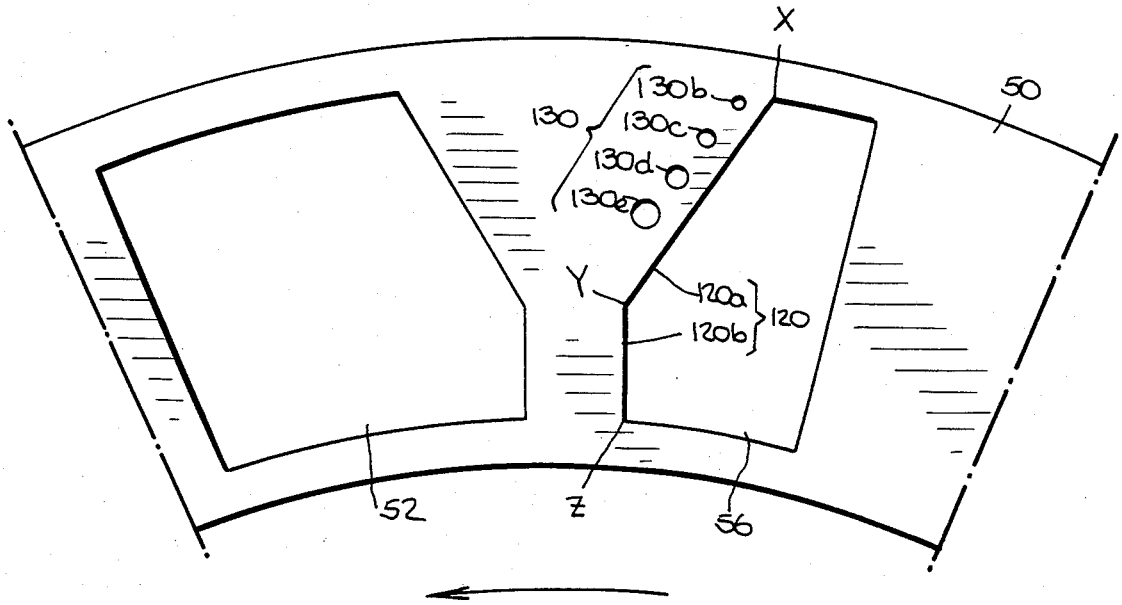
Figure 8:
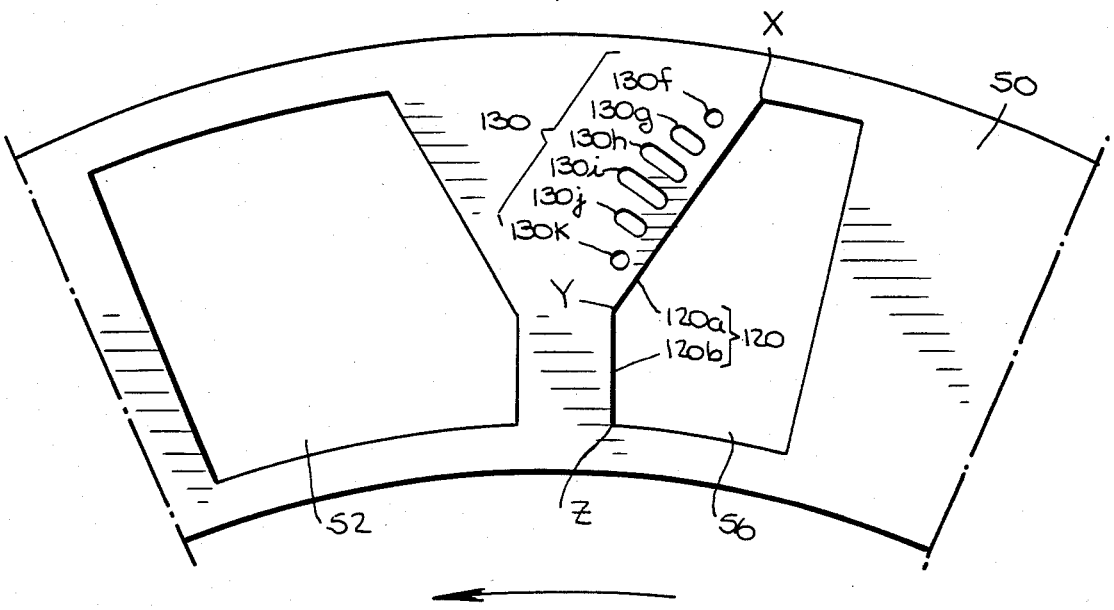
Figure 9:
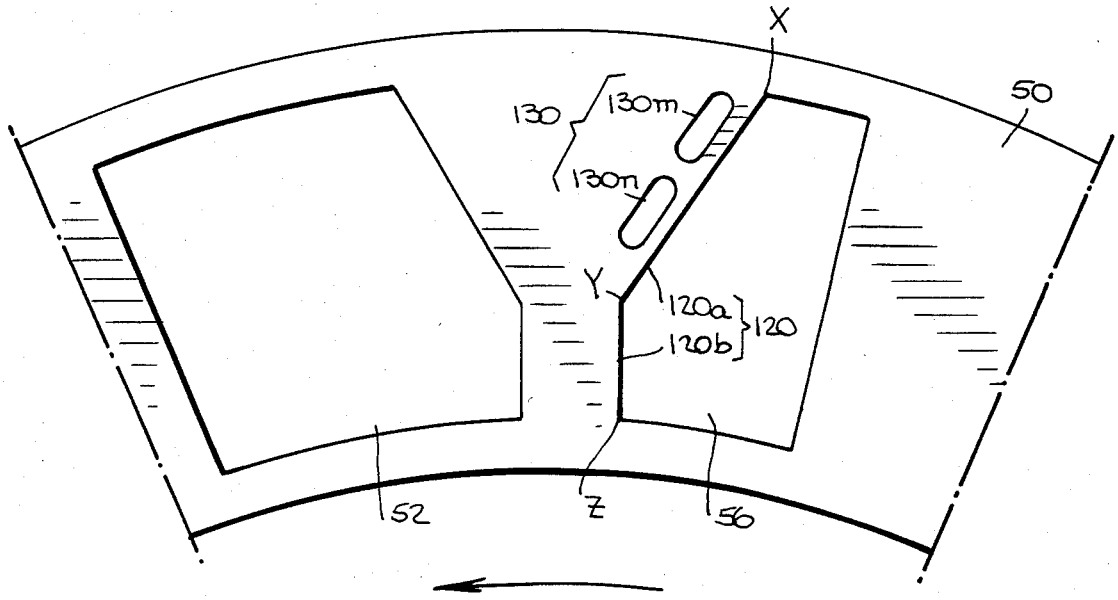
Figure 10:
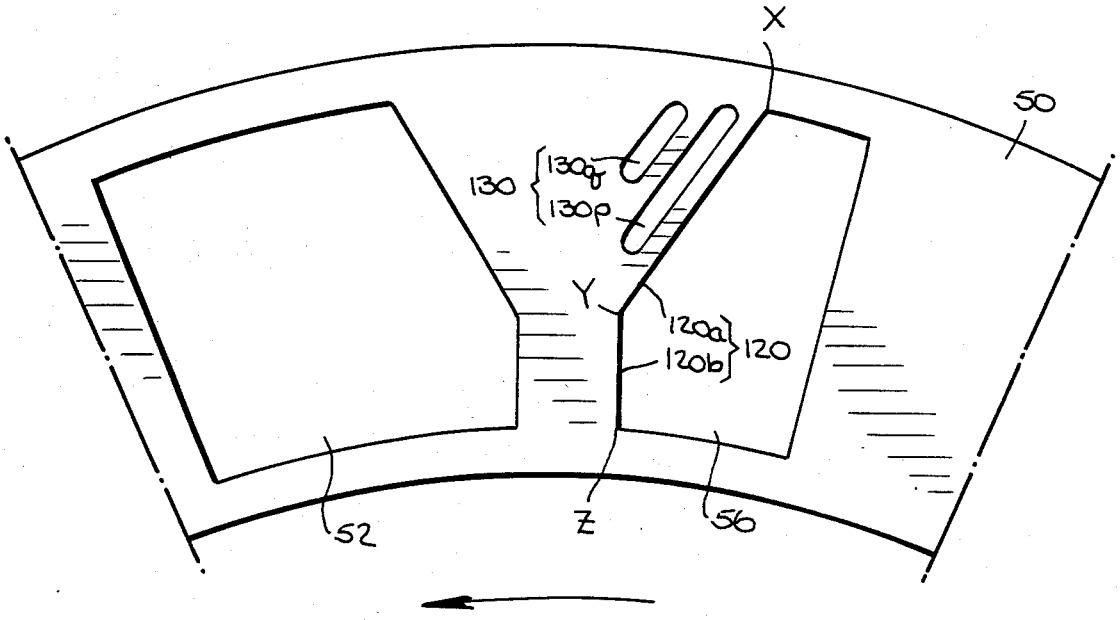

A feature which is generally common to all of the foregoing alternative embodiments of the invention is that subsidiary discharge port 130—whether unitary, as in FIGS. 5 and 11, or comprised of a plurality of apertures, as in FIGS. 6–10—preferably extends along at least a major portion (i.e., substantially more than 50%) of the length of inclined closing edge portion 120*a*. In this way, cavitation along substantially the entire length of inclined closing edge portion 120*a* is reduced or eliminated. For example, where subsidiary discharge port 130 comprises a plurality of apertures spaced along inclined closing edge portion 120*a* (as in the embodiments of FIGS. 6–9), those apertures are preferably spaced out along at least a major portion of the length of inclined closing edge portion 120*a* so that substantially the entire length of inclined closing edge portion 120*a* is served by the several portions of the subsidiary discharge port.

Another feature which is generally common to all of the foregoing embodiments is that the opening edge of subsidiary discharge port 130 (i.e., the edge of the subsidiary discharge port or its constituent apertures closest to inclined closing edge segment 120*a*) is substantially parallel to inclined closing edge segment 120*a*. This also helps to assure that cavitation is substantially reduced or eliminated along the entire length of inclined closing edge segment 120*a*.

Still another feature common to all of the foregoing embodiments is that the closing edge of subsidiary discharge port 130 is before the point, in the direction of rotor rotation, at which the outer periphery of the rotor is closest to the annular inner surface of the pump housing.

The subsidiary discharge port 130 of this invention preferably communicates directly with discharge conduit 58 in port member 50. Subsidiary discharge port 130 is primarily a gas discharge port, although some excess pumping liquid is also typically discharged via port 130. It has been found that the effect of subsidiary discharge port 130 is to significantly reduce cavitation and associated noise in conically ported liquid ring pumps.

Although the invention has been illustrated in its application to the first stage of conically ported two-stage liquid ring pumps, it will be understood that the invention is equally applicable to other conically ported liquid ring pump configurations, such as conically ported single-stage liquid ring pumps. For example, a conically ported single-stage liquid ring pump employing this invention could be constructed by deleting the second stage in the pump shown in the drawings and described above. Likewise, the invention could be embodied in both the first and second stages of a two-stage pump.

We claim:

1. A liquid ring pump comprising:

an annular housing;

a rotor rotatably mounted in the housing and having a frusto-conical bore concentric with the rotor axis;

a frusto-conical port member disposed in the bore and fixedly mounted relative to the housing, the port member including (1) a gas intake port, (2) a first gas discharge port located beyond the intake port in the direction of rotor rotation and having a closing edge including a segment which is inclined in the direction of rotor rotation from a first relatively large diameter circumference portion of the port member to a second relatively small diameter circumference portion of the port member, the first and second circumference portions being axially spaced from one another along the rotor axis, and (3) a second gas discharge port spaced from the first discharge port and located beyond the inclined closing edge segment but before the intake port in the direction of rotor rotation, the second gas discharge port including a plurality of apertures spaced from one another along at least a major portion of the length of the inclined closing edge segment.

2. The apparatus defined in claim 1 wherein the apertures include a plurality of longitudinal slots, the longitudinal axis of each slot being substantially parallel to the inclined closing edge portion and the slots being disposed in end-to-end relationship to one another.

3. The apparatus defined in claim 1 wherein the apertures include a plurality of substantially circular holes.

4. The apparatus defined in claim 3 wherein the holes are substantially equidistant from the inclined closing edge segment.

5. A liquid ring pump comprising:

an annular housing;

a rotor rotatably mounted in the housing and having a frusto-conical bore concentric with the rotor axis;

a frusto-conical port member disposed in the bore and fixedly mounted relative to the housing, the port member including (1) a gas intake port, (2) a first gas discharge port located beyond the intake port in the direction of rotor rotation and having a closing edge including a segment which is inclined in the direction of rotor rotation from a first relatively large diameter circumference portion of the port member to a second relatively small diameter circumference portion of the port member, the first and second circumference portions being axially spaced from one another along the rotor axis, and (3) a second gas discharge port spaced from the first discharge port and located beyond the inclined closing edge segment but before the intake port in the direction of rotor rotation, the second gas discharge port having (a) an opening edge which is substantially parallel to the inclined closing edge segment, and (b) a closing edge having (i) a mid-portion spaced from the opening edge, and (ii) end portions on each side of the mid-portion which are inclined toward respective opposite ends of the opening edge.

* * * * *